US010412482B2

(12) United States Patent
Hernandez Garcia et al.

(10) Patent No.: US 10,412,482 B2
(45) Date of Patent: Sep. 10, 2019

(54) LOUDSPEAKER APPARATUS

(71) Applicant: Merry Electronics(Shenzhen) Co., Ltd., Guangdong (CN)

(72) Inventors: Diego Jose Hernandez Garcia, Taichung (TW); Che-Wei Hsu, Taichung (TW); Chih-Hung Lee, Taichung (TW)

(73) Assignee: Merry Electronics (Shenzhen) Co., Ltd., Guangdong (CN)

( * ) Notice: Subject to any disclaimer, the term of this patent is extended or adjusted under 35 U.S.C. 154(b) by 56 days.

(21) Appl. No.: 15/807,543

(22) Filed: Nov. 8, 2017

(65) Prior Publication Data

US 2019/0141439 A1 May 9, 2019

(51) Int. Cl.

| | |
|---|---|
| ***H04R 1/02*** | (2006.01) |
| ***H04R 1/28*** | (2006.01) |
| ***H04R 3/12*** | (2006.01) |

(52) U.S. Cl.

CPC ..... *H04R 1/2896* (2013.01); *H04R 1/025* (2013.01); *H04R 3/12* (2013.01)

(58) Field of Classification Search

CPC ..... H04R 1/2896; H04R 1/025; H04R 3/12; H04R 1/2811; H04R 3/002; H04R 3/04; H04R 2430/03

See application file for complete search history.

(56) References Cited

U.S. PATENT DOCUMENTS

| | | | | |
|---|---|---|---|---|
| 7,796,768 | B2 * | 9/2010 | Manrique | H04R 1/02 381/96 |
| 8,774,424 | B2 * | 7/2014 | Fletcher | H04R 1/403 381/304 |
| 8,971,542 | B2 | 3/2015 | Lau et al. | |
| 9,247,342 | B2 | 1/2016 | Croft, III | |
| 9,820,075 | B2 * | 11/2017 | Macours | H04S 7/30 |
| 2014/0029782 | A1 * | 1/2014 | Rayner | H04R 1/2834 381/386 |

FOREIGN PATENT DOCUMENTS

| | | | |
|---|---|---|---|
| JP | 09247748 A | * | 9/1997 |
| TW | M366851 | | 10/2009 |
| TW | I523545 | | 2/2016 |

* cited by examiner

*Primary Examiner* — Brian Ensey
(74) *Attorney, Agent, or Firm* — JCIPRNET

(57) ABSTRACT

The disclosure provides a loudspeaker apparatus and a method of driving the acoustic transducers by predicting and compensating a physical phenomenon of acoustic pressure changes within an enclosure caused by at least one of the acoustic transducers. The loudspeaker apparatus includes an enclosure having an inner space, a first acoustic transducer, a second acoustic transducer, and a controller. The first and second acoustic transducers are mounted on the enclosure and share the same inner space of the enclosure, such as sound bar and the likes. For the operation of the loudspeaker apparatus, the controller applies an algorithm or mathematical model (e.g., transfer function) to an audio signal received from an external source, so that the sound respectively outputted by the first and second acoustic transducers sharing the same inner space may be compensated as if the first and second acoustic transducers are individually mounted on its own enclosure.

16 Claims, 5 Drawing Sheets

LOUDSPEAKER APPARATUS

BACKGROUND

Technical Field

The invention relates a loudspeaker system, and more particularly, a loudspeaker system that actively cancels an interaction between loudspeakers sharing the same enclosure.

Description of Related Art

In a loudspeaker system, a plurality of loudspeakers (also referred as drivers or acoustic transducers) may be mounted on the same enclosure box, where the loudspeakers would share the same inner space with in the enclosure box. When sharing the same inner space, the movement of the diaphragm of one loudspeaker would affect the diaphragm of another loudspeaker due to the acoustic pressure change within the enclosure box. This influence would be most notorious in low frequencies, where the loudspeakers have a large diaphragm excursion.

For example, the loudspeaker system may include a first loudspeaker and a second loudspeaker sharing the inner space of the enclosure box. When the first loudspeaker is activated, the movement of the diaphragm corresponding to the first loudspeaker would compress or expand the volume of the air within the inner space of the enclosure box. Assuming that the second loudspeaker is idle (i.e., not active), the diaphragm of the second loudspeaker would be affect by the movement of the diaphragm of the first loudspeaker due to the compression or expansion of the air within the inner space of the enclosure.

When the first and second loudspeakers are in phase, an interaction between the movement of the diaphragms of the first and second loudspeaker would attenuate the peak displacement of the diaphragm of each loudspeaker. On the other hand, when the first and second loudspeakers are out of phase, the interaction between their diaphragms would obtain a greater diaphragm excursion. This situation would generate clipping distortion and may damage the loudspeaker. In addition, if the generated frequency is low and the loudspeakers are close to each other, the acoustic pressure generated is cancelled in the far field (which starts at few centimeters for low frequency.) In this situation, the diaphragm of the loudspeakers would move, however, no sound would be generated, causing a waste of energy.

Conventionally, enclosure box may be designed with compartments, where each of the loudspeakers being mounted on the enclosure box would have its own inner space, so that the interaction between the loudspeakers due to the change of air volume inside of the enclosure box is removed. However, the compartments would decrease the volume where the speakers are mounted, therefore the low frequency performance of the loudspeaker system will be compromised.

Nothing herein should be construed as an admission of knowledge in the prior art of any portion of the present invention. Furthermore, citation or identification of any document in this application is not an admission that such document is available as prior art to the present invention, or that any reference forms a part of the common general knowledge in the art.

SUMMARY

The disclosure is directed to an operating method, an electronic device and a computer-readable recording medium for automatically launching or starting an application based on sensor data of sensors disposed on at least two different sides of the electronic device.

In one of the exemplary embodiments of the disclosure, a loudspeaker apparatus is provided. The loudspeaker apparatus includes an enclosure having an inner space, a first acoustic transducer, a second acoustic transducer, and a controller. The first and second acoustic transducers are mounted to the enclosure and sharing the same inner space of the enclosure. The controller is coupled to the first and second acoustic transducers, and configured for receiving an audio signal, generating a compensated audio signal based on an acoustic pressure variation of the inner space induced by operation of the first and second acoustic transducers, and driving the first and second acoustic transducers based at least on the compensated audio signal.

In one of the exemplary embodiments of the disclosure, a loudspeaker apparatus is provided. The loudspeaker apparatus includes an enclosure having an inner space, a first acoustic transducer, a second acoustic transducer, and a controller. The first and second acoustic transducers are mounted to the enclosure. The controller is coupled to the first and second acoustic transducers, and configured for receiving a first audio signal for driving the first acoustic transducer, estimating a displacement of the second acoustic transducer based on the first audio signal, modifying the first audio signal based at least on the estimated displacement of the second acoustic transducer, and driving the first acoustic transducer based at least on the modified first audio signal.

In one of the exemplary embodiments of the disclosure, a method for compensating an influence of a plurality of acoustic transducers sharing an inner space of an enclosure is provided. The method includes at least the following steps: receiving an audio signal for driving the acoustic transducers, generating a compensated audio signal based on an acoustic pressure variation of the inner space induced by operation of the acoustic transducers, and driving the acoustic transducers based at least on the compensated audio signal.

To make the above features and advantages of the disclosure more comprehensible, several embodiments accompanied with drawings are described in detail as follows.

It should be understood, however, that this Summary may not contain all of the aspects and embodiments of the present invention, is not meant to be limiting or restrictive in any manner, and that the invention as disclosed herein is and will be understood by those of ordinary skill in the art to encompass obvious improvements and modifications thereto.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
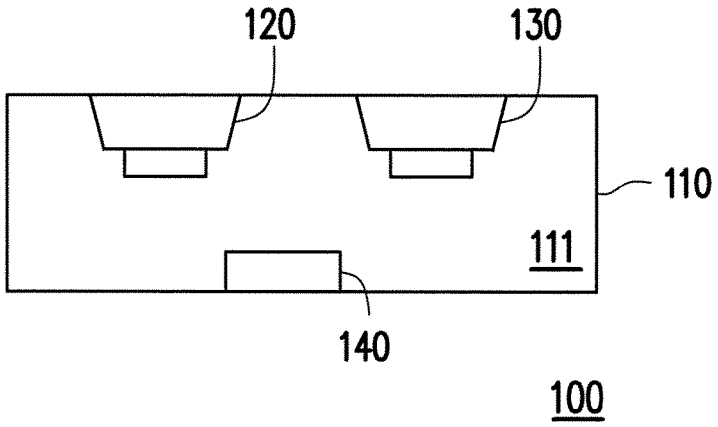
FIG. 1 is a diagram illustrating a loudspeaker apparatus according to one of the exemplary embodiments of the disclosure.

Reference will now be made in detail to the present preferred embodiments of the invention, examples of which are illustrated in the accompanying drawings. Wherever possible, the same reference numbers are used in the drawings and the description to refer to the same or like parts.

In the disclosure, a novel loudspeaker apparatus is provided for predicting and compensating a physical phenomenon of acoustic pressure change within an enclosure caused by at least one of the acoustic transducers. The loudspeaker apparatus includes an enclosure having an inner space, a first acoustic transducer, a second acoustic transducer, and a controller. The first and second acoustic transducers are mounted on the enclosure and share the same inner space of the enclosure, such as sound bar and the likes. For the operation of the loudspeaker apparatus, the controller applies an algorithm or mathematical model (e.g., impulse response h(t) in time domain or transfer function H(s) in frequency domain) to an audio signal received from an external source, so that the sound respectively outputted by the first and second acoustic transducers sharing the same inner space may be compensated as if the first and second acoustic transducers are individually mounted on its own enclosure.

FIG. 1 is a diagram illustrating a loudspeaker apparatus according to one of the exemplary embodiments of the disclosure. With reference to FIG. 1, the loudspeaker apparatus 100 includes an enclosure 110, a first acoustic transducer 120, a second acoustic transducer 130, and a controller 140. In FIG. 1, it is illustrated that the first and second acoustic transducer 120, 130 are mounted on the same side of the enclosure 110. However, the disclosure is not intended to limit the mounting configuration of the first and second acoustic transducers 120, 130. In other exemplary embodiments, the first and second acoustic transducers 120, 130 may be mounted on different sides of the enclosure 100.

The enclosure 110 of the loudspeaker apparatus 100 is an enclosed area having a fixed volume filled with air, where the enclosed area is referred to as an inner space 111 of the enclosure 110. Movements of the diaphragm of the first and second acoustic transducers 120, 130 mounted thereon would cause the physical phenomenon of acoustic pressure change within the enclosure, i.e., compress or expand the air volume within the enclosure 100. For example, an inward movement of the diaphragm of the first acoustic transducer 120 or the second acoustic transducer 130, the air within the inner space 111 would be compressed. On the other hand, an outward movement of the diaphragm of the first acoustic transducer 120 or the second acoustic transducer 130 would expand the air within the inner space 111. In either cases, the acoustic pressure of the inner space 111 changes due to the movements of the diaphragms of the first or second acoustic transducer 110, 120. In other words, the first and second acoustic transducers 110, 120 sharing the same inner space 111 of the enclosure 110 interfere with each other.

Figure 2:
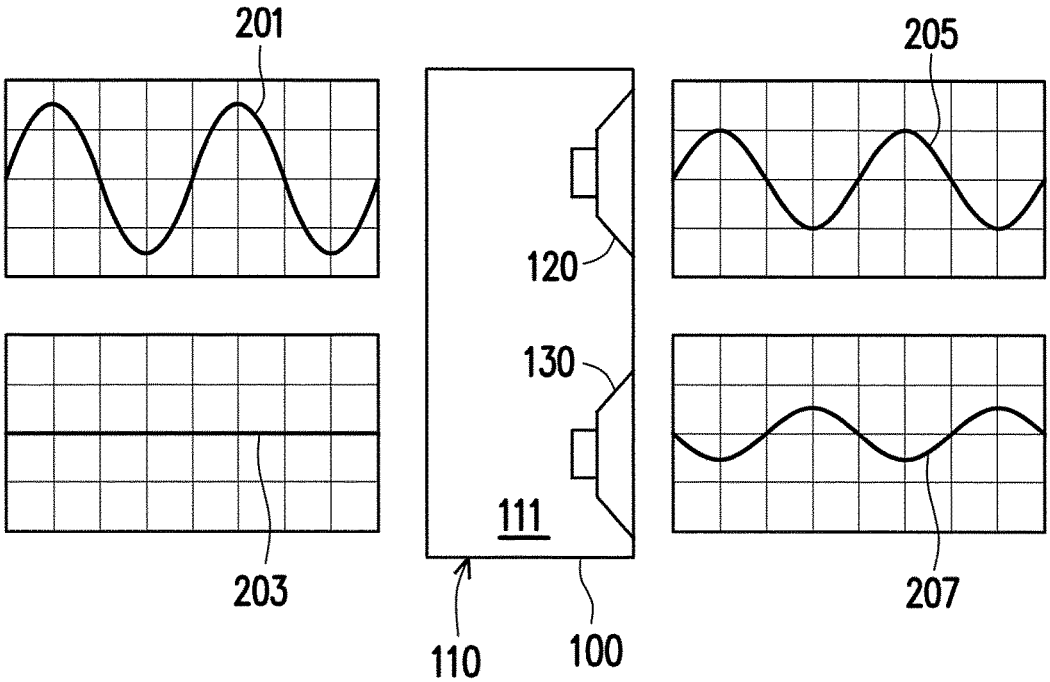
FIG. 2 is a diagram illustrating operations of the first and second acoustic transducers that introduces the physical phenomenon of acoustic pressure change within the enclosure of a loudspeaker apparatus.

The exemplary embodiment illustrated in FIG. 2 shows that the controller 140 is disposed at the bottom and inside of the enclosure 110, however, the exemplary embodiment is not intended to limit the location of the controller 140. In some exemplary embodiments, the controller may be mounted inside of the enclosure and on the same surface as the acoustic transducers. In other exemplary embodiments, the controller 140 may be disposed outside of the enclosure 110 and coupled to the acoustic transducers via wired or wireless connection. Nevertheless, the controller 140 may be placed anywhere as long as it receives audio signal, and drives the acoustic transducers according to the received audio signal.

In the following, FIG. 2 is utilized for a better describing the physical phenomenon of acoustic pressure change within the enclosure. FIG. 2 is a diagram illustrating operations of the first and second acoustic transducers 120, 130 that introduces the physical phenomenon of acoustic pressure change within the enclosure 110 of a loudspeaker apparatus 100. With reference to FIG. 2, a first audio signal 201 is provided to the first acoustic transducer 120 while no input, or a second audio signal 203 instructing the second acoustic transducer 130 not to output, is provided to the second acoustic transducer 130. Due to the inner space 111 of the enclosure 110, the diaphragm of the second acoustic transducer 130 would be affected by the movement of the diaphragm of the first acoustic transducer 120 as the first audio signal 201 drives the first acoustic transducer 120. It should be noted that, at the same time, the output of the first acoustic transducer 220 would not reach a desired level since the diaphragm of the second acoustic transducer 230 limits the physical movement of the diaphragm (diaphragm excursion) of the first acoustic transducer 220. In other words, the first and second acoustic transducers 220, 230 would affect each other due to a physical factor of sharing the same inner space 211.

It is also shown in FIG. 2 the displacements of the diaphragms of the first and second acoustic transducers 120, 130. In the exemplar embodiment, output sounds or displacements of the diaphragms of the first and second acoustic transducers 120, 130 would be represented by a first output signal 205 and a second output signal 207 for the sake of simplicity, where the measured displacements may be converted into electrical signals in a similar scale as the audio signals for representation. With reference to FIG. 2, the peak of the first output signal 205 of the first acoustic transducer 120 is lower than the first acoustic signal 201, indicating that the physical displacement of the diaphragm of the first acoustic transducer 120 is reduced. Further, the second output signal 207 of the second acoustic transducer 130 indicates a small displacement of the diaphragm of the second acoustic transducer 130 while no output from the second acoustic transducer 130 is desired based on the first audio signal 203. That is, the diaphragm of the second acoustic transducer 130 is moved based on the acoustic pressure changes within the inner space 211 induced by the movement of the diaphragm of the first acoustic transducer 220, and the physical displacement of the first acoustic transducer 120 is limited by the diaphragm of the second acoustic transducer 130.

In the exemplary embodiment, the first and second output signals 205, 207 represents the physical displacement of the first and second acoustic transducers 120, 130, respectively, which may be measured by a displacement sensor, for example, laser, accelerometer, etc. during system identification. Further description on the system identification would be described later. Furthermore, the embodiment is not intended to limit the means for measuring the physical displacement of the diaphragms, other means for measuring the displacement of the diaphragm of the acoustic transducer may be utilized.

The effect of this physical phenomenon of the acoustic pressure change within an enclosure would be considered, and accordingly the received audio signals may be adjusted or compensated, so as to cancel the interactions between a plurality of acoustic transducers that share the same inner space of an enclosure.

Figure 3:
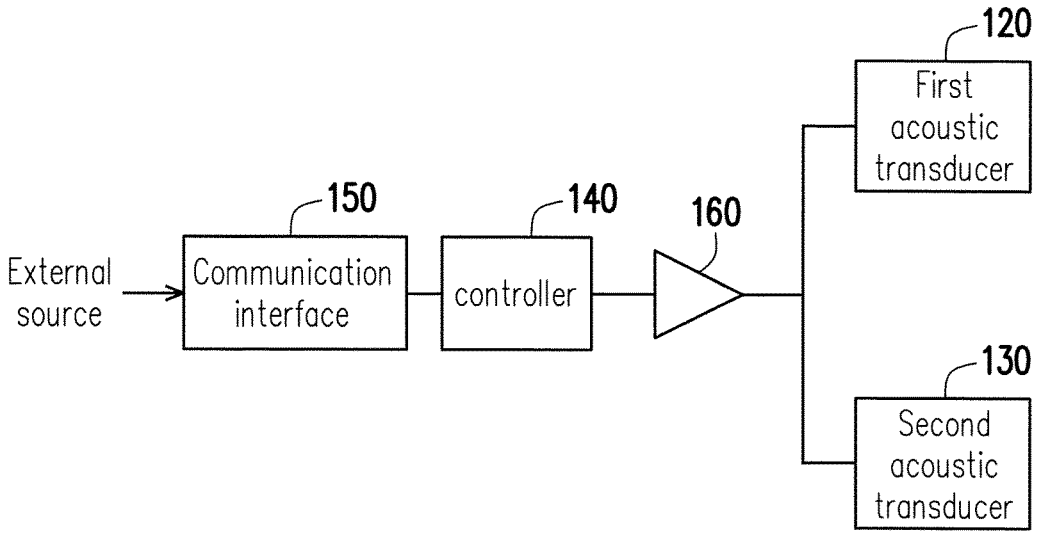
FIG. 3 is a block diagram illustrating a loudspeaker apparatus according to one of the exemplary embodiments of the disclosure.

FIG. 3 is a block diagram illustrating a loudspeaker apparatus according to one of the exemplary embodiments of the disclosure. With reference to FIG. 3, the controller 140 is electrically connected to the first and second acoustic transducers 120, 130, and the connection there between may be directly or indirectly. In some exemplary embodiments, the controller 140 may be further electrically connected to a communication interface 150 for receiving audio signals from an external source. The external source may be computer, mobile electronics, TV, or any audio players.

The controller 140 handles or controls a portion or all of the operations of the loudspeaker apparatus 100. In the exemplary embodiment, the controller 140 may include one or more processors having generic characteristics similar to general purpose processing unit, such as a central processing unit (CPU), or may be application specific integrated circuitry (ASIC) that provides arithmetic and control functions to the loudspeaker apparatus 100. In some exemplary embodiments, the controller 140 may be implemented by executing instructions loaded from a memory (not shown), or logic circuits programmed to provide arithmetic operations. In some exemplary embodiments, the controller 140 may be a microprocessor and a digital signal processor (DSP), a programmable controller, a programmable logic device (PLD), other similar devices or a combination of aforementioned devices. Furthermore, the controller 140 may also include filters for filtering the received input signals, and analog and digital circuits for converting digital signals to analog audio signals or analog to digital signal. After the digital signal processing in controller 140, the output signal of the DSP is amplified to drive the loudspeakers. For this purpose, an audio power amplifier 160 is employed between the controller 140 and the loudspeakers 120, 140.

The communication interface 150 is connected to the controller 140 and may include wired or wireless communication interface for transmitting or receiving signals to or from an external source, such as a transceiver. For example, the wired communication interface may include at least 3.5 mm jack plug, RCA jack plug, coaxial connector, optical connector, HDMI, Thunderbolt, and the like. The wireless communication interface may include at least WiFi, NFC, Bluetooth, and the like. There are various hardware and protocols for transmitting or receiving signals to or from an external source, the disclosure is not intended to limit the type of the communication interface.

Figure 4:
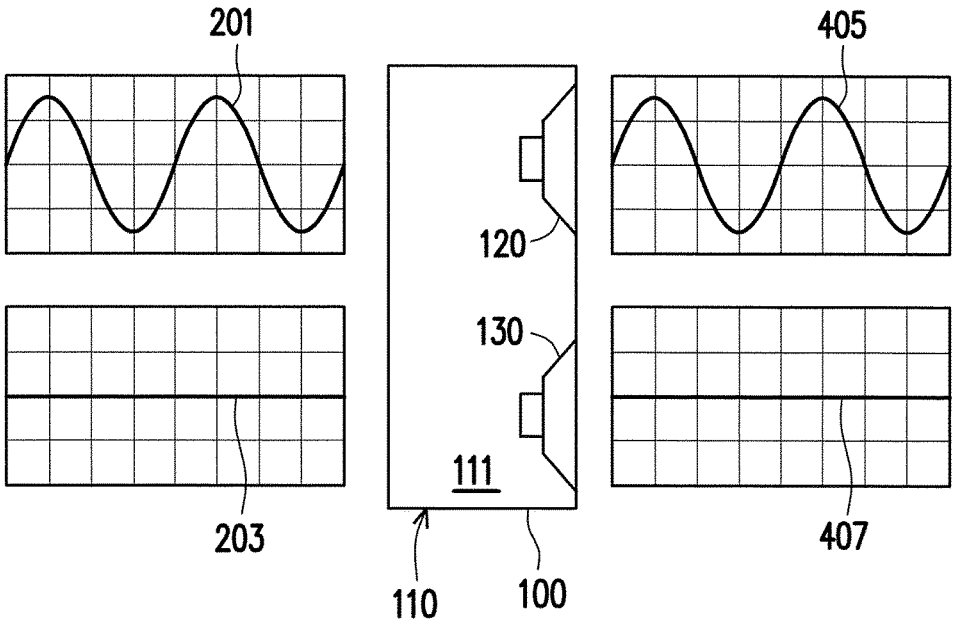
FIG. 4 is a diagram illustrating operations of a first acoustic transducer and a second acoustic transducer that compensates the physical phenomenon of acoustic pressure change within an enclosure of a loudspeaker apparatus according to one of the exemplary embodiments of the disclosure.

FIG. 4 is a diagram illustrating operations of the first acoustic transducer 120 and the second acoustic transducer 130 that compensates the physical phenomenon of acoustic pressure change within the enclosure 110 of a loudspeaker apparatus 100 according to one of the exemplary embodiments of the disclosure.

With reference to FIGS. 3 and 4, the loudspeaker apparatus 100 may receive an input signal from an external source, where the input signal may include the first audio signal 201 for driving the first acoustic transducer 320 and the second audio signal 203 for driving the second acoustic transducer 330. Similar to the embodiment illustrated in FIG. 2, the first audio signal 201 shows waveforms representing a desired audio to be output by the first acoustic transducer 320, and the second audio signal 203 shows a flat signal indicating that no output is desired for the second acoustic transducer 330.

In the exemplary embodiment, the first and second audio signals 201, 203 are feed to the controller 140 of the loudspeaker apparatus 100, where the control 140 is preconfigured with a transfer function, H(s), that describes the interactions between a plurality of acoustic transducers sharing the same inner space. The controller 140 applies the transfer function to the received audio signals 201, 203, and then outputs a first compensated audio signal and a second compensated audio signal for driving the first and second acoustic transducers 120, 130. By using the transfer function H(s), the controller 140 predicts the diaphragm displacement of each acoustic transducer caused by other acoustic transducer(s) and compensates the original audio signal to cancel the interaction between the acoustic transducers sharing the same inner space of an enclosure. Assuming that the first and second audio signals 201, 203 are the same between the embodiments illustrated in FIGS. 2 and 4, the controller 150 compensates the first audio signal 201 by increasing the power of the original first audio signal 201 to compensate the pulling of the diaphragm of the second acoustic transducer 130. On the other hand, the controller 140 compensates the effect of the physical displacement of the first acoustic transducer 120 on the second acoustic transducer 120 by applying the transfer function H(s) to the original first audio signal 203, forcing the diaphragm displacement of the second acoustic transducer 130 to zero. In some exemplary embodiments, the controller 140 outputs a second compensated output signal 407 that is inverse of the physical displacement 207 of the diaphragm of the second acoustic transducer 130 illustrated in FIG. 2 to drive the second acoustic transducer 130.

The controller 140 then respectively drives the first and second acoustic transducers 120, 130 based on the first and second compensated output signals 405, 407. As compared to the first output signals 205, 207 illustrated in FIG. 2, the controller 140 successfully compensates the effect of acoustic pressure changes within the inner space 111 of the enclosure 110 by using the transfer function H(s).

Figure 5:
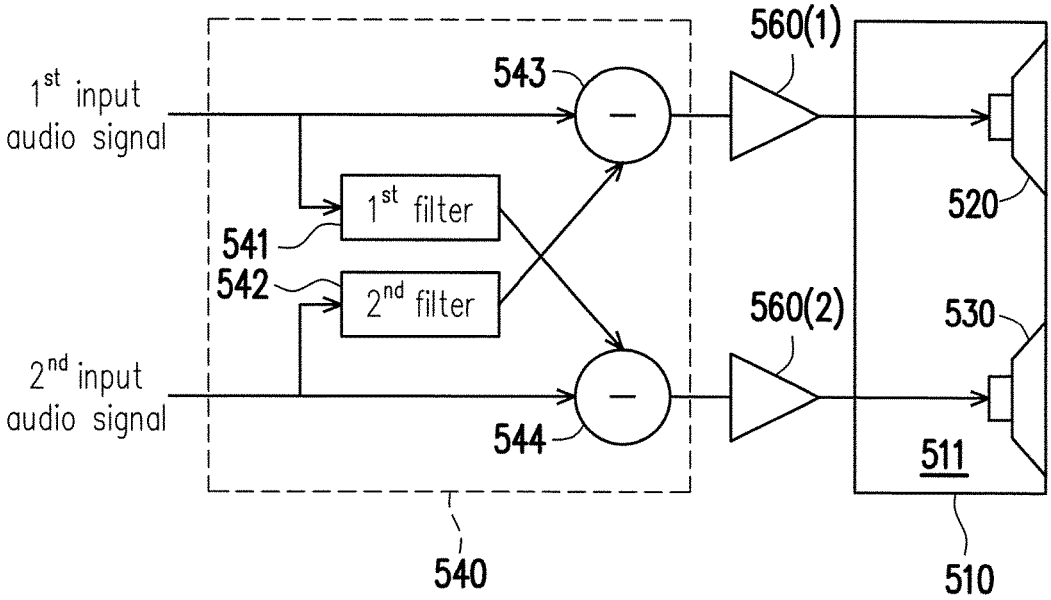
FIG. 5 is a block diagram illustrating a controller of a loudspeaker apparatus according to one of the embodiment of the disclosure.

FIG. 5 is a block diagram illustrating a controller 540 of a loudspeaker apparatus according to one of the embodiment of the disclosure. With reference to FIG. 5, the controller 540 includes a first filter 541, a second filter 542, a first combiner 543, and a second combiner 544. The first filter 541 may be configured or programmed with a first transfer function $H_{12}(s)$ representing the effect of the first audio signal (which is utilized to drive the first acoustic transducer 510) to a second acoustic transducer 520. Movement of the diaphragm of the second acoustic transducer 520 caused by the diaphragm of a first acoustic transducer 510 when driven by the first audio signal may be estimated by the first filter 541. On the other hand, the second filter 542 is configured or programmed with a second transfer function $H_{21}(s)$ representing an effect of the second audio signal (which is utilized to drive the second acoustic transducer 520) to a first acoustic transducer 510. Movement of the diaphragm of the first acoustic transducer 510 caused by the diaphragm of the second acoustic transducer 530 when driven by the second audio signal may be estimated by the second filter 542.

In the exemplary embodiment, the first transfer function $H_{12}(s)$ describes an effect of first acoustic transducer 520 when driven by the first audio signal would have to the second acoustic transducer 530. The second transfer function $H_{21}(s)$ describes an effect of the second acoustic transducer 530 when driven by the second audio signal would have to the first acoustic transducer 520. The output of the first and second acoustic transducers 520, 530 may be represented by the mathematical formula shown below:

$$Y_1(s)=X_1(s)-H_{21}(s)X_2(s)$$

$$Y_2(s)=X_2(s)-H_{12}(s)X_1(s)$$

Where $Y_1(s)$ represents the output of the first acoustic transducer 520;

$Y_2(s)$ represents the output of the second acoustic transducer 530;

$X_1(s)$ represents the first audio signal;

$X_2(s)$ represents the second audio signal;

$H_{21}(s)$ represents the second transfer function corresponding to an effect of the second acoustic transducer 530 when driven by the second audio signal to the first acoustic transducer 520; and $H_{12}(s)$ represents the first transfer function corresponding to an effect of the first acoustic transducer 530 when driven by the first audio signal to the second acoustic transducer 540.

The transfer functions $H_{12}(s)$ and $H_{21}(s)$ may be obtained by system identification technique, using stimulus (input) and response (output) signals measured from the loudspeaker system. The measured signals employed for the system identification may be electrical (e.g., measured at the input of the loudspeaker system), acoustical (e.g., measured inside the enclosure) and/or mechanical (e.g., measured at the driver diaphragms). Then, the first and second transfer functions $H_{12}(s)$, $H_{21}(s)$ may be implemented as filters. For example, by using finite impulse response FIR filters with the identified impulse responses. Therefore, the exemplary embodiments of the disclosure may predict the movement of the diaphragm caused by the acoustic pressure changes induced by the acoustic transducers based on the identified system. Once all the transfer functions are identified, they are stored in the internal memory of the controller for future use. No further transfer function identification is required for next times that the loudspeaker apparatus is turned on. In the exemplary embodiments, if any element (acoustic drivers, enclosure size, amplifiers, etc.) in the audio path from the input to the output is modified, the transfer functions may need to be identified again.

In detail, the first audio signal is respectively coupled to the first filter 541 and the first combiner 543. The first filter 541 applies the first transfer function $H_{12}(s)$ to the first audio signal and generates the filtered first audio signal. Then, from the first filter 541, the filtered first audio signal is coupled to the second combiner 544. On the other hand, the second audio signal is respectively coupled to the second filter 542 and the second combiner 544. The second filter 542 applies the second transfer function $H_{21}(s)$ to the second audio signal and generates the filtered second audio signal. Then, from the second filter 542, the filtered second audio signal is coupled to the first combiner 543.

Next, the first combiner 543 combines or sums the first audio signal and the filtered second audio signal as to compensate an effect to which the diaphragm of the second acoustic transducer 530 would have on the diaphragm of the first acoustic transducer 520. The first combiner 543 then generates a first compensated audio signal for driving the first acoustic transducer 520 with a first amplifier 160(1). Similarly, the second combiner 544 combines or sums the second audio signal and the filtered first audio signal as to compensate an effect to which the diaphragm of the first acoustic transducer 520 would have on the diaphragm of the second acoustic transducer 530. The second combiner 544 would then generate a second compensated audio signal for driving the second acoustic transducer 530 with a second amplifier 160(2).

Figure 6:
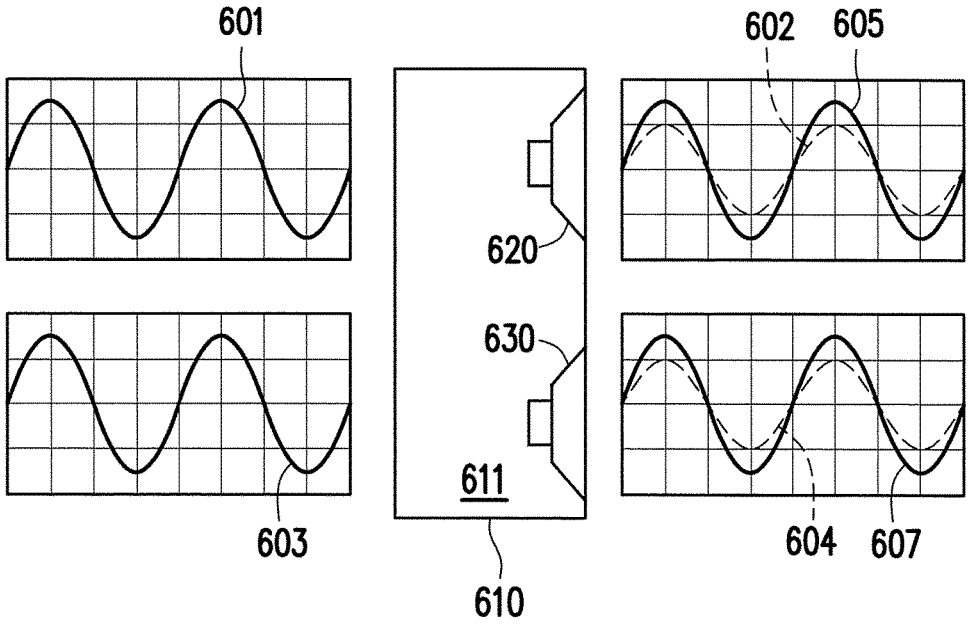
FIG. 6 is a diagram illustrating a loudspeaker apparatus according to one of the exemplary embodiments of the disclosure.

FIG. 6 is a diagram illustrating a loudspeaker apparatus according to one of the exemplary embodiments of the disclosure. In the exemplary embodiment, the operations of the first and second acoustic transducers 620, 630 are moving in-phase. The first and second acoustic transducers 620, 630 would influence each other and resulting in a reduction of the maximum peak displacement of each acoustic transducers intended by the original audio signals 601, 603, which is illustrated by waveforms 602, 604 drawn in dotted line. As the diaphragm of the first acoustic transducer 620 moves inward, the acoustic pressure changes within the inner space 611 of the enclosure 610 would push the diaphragm of the second acoustic transducer 630 outward. When the operation of the first and second acoustic transducers 620, 630 are in phase, the acoustic pressure in the enclosure generated by the first and second acoustic transducers 620, 630 would work against each other. That is, as both of the first and second acoustic transducers 620, 630 move inward, the air within the enclosure would be compressed and work against the inward movement of both diaphragms. The exemplary acoustic apparatus illustrated in FIG. 6 would consider the effect of the acoustic pressure change within the inner space 611 of the enclosure 610 and compensates the output signals that drives the first and second acoustic transducers 620, 630 by using transfer functions describe above. After compensation or adjustment, the peak displacement of the first and second acoustic transducers 620, 630 may be restored to a level that was intended in signals 605 and 607.

Figure 7:
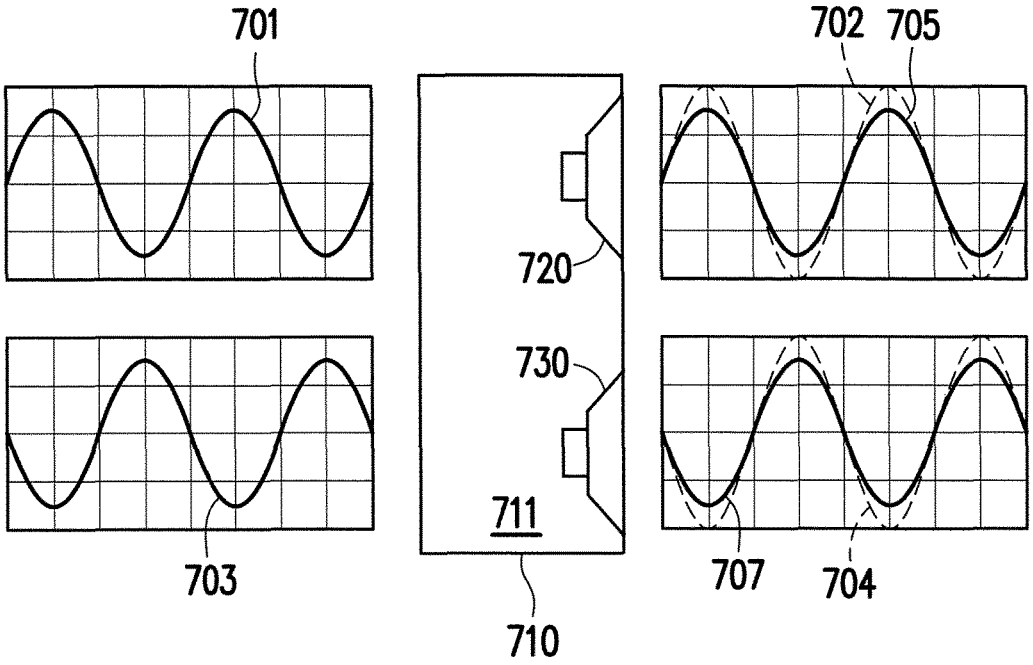
FIG. 7 is a diagram illustrating a loudspeaker apparatus according to one of the exemplary embodiments of the disclosure.

FIG. 7 is a diagram illustrating a loudspeaker apparatus according to one of the exemplary embodiments of the disclosure. In the exemplary embodiment, the operations of the first and second acoustic transducers 720, 730 are out of phase. The first and second acoustic transducers 720, 730 would influence each other and resulting in an increase of the maximum peak displacement of each acoustic transducers intended by the original audio signals 701, 703, which is illustrated by waveforms 702, 704 drawn in dotted line. As the diaphragm of the first acoustic transducer 720 moves inward, the acoustic pressure changes within the inner space 711 of the enclosure 710 would push the diaphragm of the second acoustic transducer 730 outward. When the operations of the first and second acoustic transducers 720, 730 are out of phase, the opposite operation of the first and second acoustic transducers 720, 730 would increase the peak displacement of the acoustic transducer that is moving outward. The exemplary acoustic apparatus illustrated in FIG. 7 would consider the effect of the acoustic pressure change within the inner space 711 of the enclosure 710 and compensates the output signals that drives the first and second acoustic transducers 720, 730 by using transfer functions describe above. After compensation or adjustment, the peak displacement of the first and second acoustic transducers 720, 730 may be restored to a level that was intended in signals 705, 707.

Although the above exemplary embodiments were presented by using two acoustic transducers, the disclosure is not limited thereto. The disclosure may be applied to various numbers of the acoustic transducers, such as 3, 4 . . . n acoustic transducers. If there are n acoustic transducers mounted on an enclosure sharing the same inner space, the output of each of the acoustic transducers may be compensated by considering the effect of each of the other acoustic transducers. The output of each of n acoustic transducers may be represented as follows:

$$Y_1(s)=X_1(s)-H_{21}(s)X_2(s)-H_{31}(s)X_3(s) \ldots -H_{n1}(s)X_n(s)$$

$$Y_2(s)=X_2(s)-H_{12}(s)X_1(s)-H_{32}(s)X_3(s) \ldots -H_{n2}(s)X_n(s)$$

$$Y_3(s)=X_3(s)-H_{13}(s)X_1(s)-H_{23}(s)X_2(s) \ldots -H_{n2}(s)X_n(s)$$

$$Y_n(s)=X_n(s)-H_{1n}(s)X_1(s)-H_{2n}(s)X_2(s) \ldots -H_{3n}(s)X_3(s)$$

Where $Y_1(s)$ represents the output of a first acoustic transducer;

$Y_2(s)$ represents the output of a second acoustic transducer;

$Y_3(s)$ represents the output of a third acoustic transducer;

$Y_n(s)$ represents the output of an nth acoustic transducer;

$X_1(s)$represents a first input audio signal;

$X_2(s)$ represents a second input audio signal;

$X_3(s)$ represents a third input audio signal;

$X_n(s)$ represents a $n^{th}$ input audio signal;

$H_{21}(s)$ represents a transfer function corresponding to an effect of the second acoustic transducer when driven by the second input audio signal to the first acoustic transducer;

$H_{31}(s)$ represents a transfer function corresponding to an effect of the third acoustic transducer when driven by the third input audio signal to the first acoustic transducer;

$H_{n1}(s)$ represents a transfer function corresponding to an effect of the $n^{th}$ acoustic transducer when driven by the $n^{th}$ input audio signal to the first acoustic transducer;

$H_{12}(s)$ represents a transfer function corresponding to an effect of the first acoustic transducer when driven by the first input audio signal to the second acoustic transducer;

$H_{32}(s)$ represents a transfer function corresponding to an effect of the third acoustic transducer when driven by the third input audio signal to the second acoustic transducer;

$H_{n2}(s)$ represents a transfer function corresponding to an effect of the $n^{th}$ acoustic transducer when driven by the $n^{th}$ input audio signal to the second acoustic transducer;

$H_{13}(s)$represents a transfer function corresponding to an effect of the first acoustic transducer when driven by the first input audio signal to the third acoustic transducer;

$H_{23}(s)$ represents a transfer function corresponding to an effect of the second acoustic transducer when driven by the second input audio signal to the third acoustic transducer; and $H_{n3}(s)$ represents a transfer function corresponding to an effect of the $n^{th}$ acoustic transducer when driven by the $n^{th}$ input audio signal to the third acoustic transducer.

Figure 8:
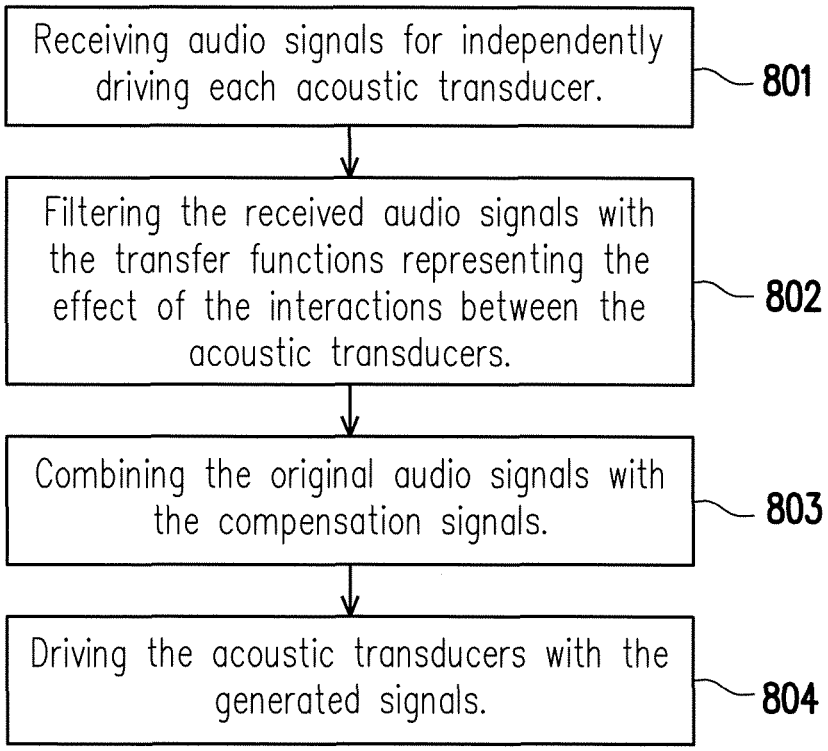
FIG. 8 is a flow diagram illustrating a method for driving a plurality of acoustic transducers sharing the same inner space of an enclosure box according to one of the exemplary embodiment of the disclosure.

FIG. 8 is a flow diagram illustrating a method for compensating acoustic pressure changes within an inner space of an enclosure of a loudspeaker apparatus according to one of the exemplary embodiments of the disclosure.

In the exemplary embodiment, a loudspeaker apparatus, for example a sound bar may include a plurality of acoustic transducers. In step 801, a controller or a processor (e.g., DSP) of the loudspeaker apparatus may receive a plurality of signals for independently driving each acoustic transducer.

The processor may include filters (e.g., FIR) configured to apply the previously identified transfer functions to the received audio signals. In step 802, each input audio signals may be filtered by a filter configured with the transfer functions representing the effect of the interactions between the acoustic transducers.

In step 803, the original audio signal and the filtered audio signals are combined to generate the signals to drive each acoustic transducer.

In step 804, the controller sends the combined signals to the amplifiers, which drive the acoustic transducers.

In summary, the exemplary embodiments described above depicted a novel loudspeaker apparatus and a novel method for driving a plurality of acoustic transducers that compensates the acoustic pressure changes within an inner space of an enclosure shared by a plurality of acoustic transducers. Based on the above, each of the acoustic transducers that share the same inner space of the enclosure box would be driven by a compensated signal that takes the acoustic pressure variation induced by other acoustic transducer(s) into account. Such may reduce the influence of the acoustic pressure variations with in the inner space, and the performance of acoustic transducers may be improved where each of the acoustic transducers are utilizing all of the volume within the inner space of the enclosure box. As a result, the actual output of the acoustic transducers would be the same or similar to the original input audio signal and the quality of the sound outputted by the acoustic transducers of the loudspeaker apparatus may be maintained.

Exemplary embodiments of the present disclosure may comprise any one or more of the novel features described herein, including in the Detailed Description, and/or shown in the drawings. While the foregoing describes a number of separate embodiments of the apparatus and method of the present disclosure, what has been described herein is merely illustrative of the application of the principles of the present disclosure. For example, as used herein various directional and orientation terms such as "vertical", "horizontal", "up", "down", "bottom", "top", "side", "front", "rear", "left", "right", and the like, are used only as relative conventions and not as absolute orientations with respect to a fixed coordinate system. Note also, as used herein the terms "process" and/or "processing unit" should be taken broadly to include a variety of electronic hardware and/or software based functions and components. Moreover, a depicted process or processing unit can be combined with other processes and/or processing units or divided into various sub-processes or processing units. Such sub-processes and/or sub-processing units can be variously combined according to embodiments herein. Likewise, it is expressly contemplated that any function, process, application, and/or processing unit here herein can be implemented using electronic hardware, software consisting of a non-transitory computer-readable medium of program instructions, or a combination of hardware and software. Accordingly, this description is meant to be taken only by way of example, and not to otherwise limit the scope of this invention.

Furthermore, as used herein, "at least one," "one or more" and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together. It is to be noted that the term "a" or "an" entity refers to one or more of that entity. As such, the terms "a" (or "an"), "one or more" and "at least one" can be used interchangeably herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A loudspeaker apparatus, comprising:
an enclosure, having an inner space;
a first acoustic transducer, mounted to the enclosure;
a second acoustic transducer, mounted to the enclosure and sharing the same inner space as the first acoustic transducer;
a controller, coupled to the first and second acoustic transducers, and configured for:
receiving a first audio signal for driving the first acoustic transducer;
filtering the first audio signal; and
driving the second acoustic transducer based at least on the filtered first audio signal,
wherein the first audio signal is filtered by applying a first transfer function,
wherein the first transfer function comprises a first model of the inner space that estimates a displacement of second acoustic transducer caused by the first acoustic transducer when the first acoustic transducer is driven by the first audio signal.

2. The loudspeaker apparatus of claim 1, wherein the controller is further configured for:
receiving a second audio signal for driving the second acoustic transducer;
combining the second audio signal and the filtered first audio signal to generate a second driving signal; and
driving the second acoustic transducer based at least on the second driving signal.

3. The loudspeaker apparatus of claim 1, wherein the controller is further configured for:
receiving a second audio signal for driving the second acoustic transducer;
filtering the second audio signal;
combining the first audio signal and the filtered second audio signal to generate a first driving signal; and
driving the first acoustic transducer based at least on the first driving signal.

4. The loudspeaker apparatus of claim 3, wherein the second audio signal is filtered by applying a second transfer function.

5. The loudspeaker apparatus of claim 4, wherein the second transfer function comprises a second model of the inner space that estimates a displacement of first acoustic transducer caused by the second acoustic transducer when the second acoustic transducer is driven by the second audio signal.

6. The loudspeaker apparatus of claim 1, further comprising:
a communication interface, coupled the controller, configured for receiving the first audio signal from an external source.

7. A method for driving acoustic transducers, comprising:
receiving a first audio signal for driving a first acoustic transducer;
filtering the first audio signal; and
driving a second acoustic transducer sharing an inner space of an enclosure with the first acoustic transducer based at least on the filtered first audio signal,
wherein the step of filtering the first audio signal comprises applying a first transfer function to the first audio signal,
wherein the first transfer function comprises a first model of the inner space that estimates a displacement of second acoustic transducer caused by the first acoustic transducer when the first acoustic transducer is driven by the first audio signal.

8. The method of claim 7, further comprising:
receiving a second audio signal for driving the second acoustic transducer;
combining the second audio signal and the filtered first audio signal to generate a second driving signal; and
driving the second acoustic transducer based at least on the second driving signal.

9. The method of claim 7, further comprising:
receiving a second audio signal for driving the second acoustic transducer;
filtering the second audio signal;
combining the first audio signal and the filtered second audio signal to generate a first driving signal; and
driving the first acoustic transducer based at least on the first driving signal.

10. The method of claim 9, wherein he step of filtering the second audio signal comprises applying a second transfer function to the second audio signal.

11. The method of claim 10, wherein the second transfer function comprises a second model of the inner space that estimates a displacement of first acoustic transducer caused by the second acoustic transducer when the second acoustic transducer is driven by the first audio signal.

12. A loudspeaker apparatus, comprising:
an enclosure, having an inner space;
a first acoustic transducer, mounted to the enclosure;
a second acoustic transducer, mounted to the enclosure and sharing the same inner space as the first acoustic transducer;
a controller, coupled to the first and second acoustic transducers, and configured for:
receiving an audio signal;
generating a compensated audio signal based on an acoustic pressure variation of the inner space induced by operation of the first and second acoustic transducers; and
driving the first and second acoustic transducers based at least on the compensated audio signal.

13. The loudspeaker apparatus of claim 12, wherein the controller comprises a filter estimating the acoustic pressure variation of the inner space induced by operation of the first and second acoustic transducers.

14. The loudspeaker apparatus of claim 13, wherein the acoustic pressure variation is estimated by applying a transfer function to the received audio signal.

15. The loudspeaker apparatus of claim 12, wherein the audio signal comprises a first audio signal for driving the first acoustic transducer and a second audio signal for driving the second acoustic transducer, and the controller comprises:

a first filter, receiving the first audio signal, and outputting a filtered first audio signal to the second acoustic transducer; and a second filter, receiving the second audio signal, and outputting a filtered second audio signal to the first acoustic transducer, wherein the first filter has a first transfer function representing a relation between the first audio signal and the displacement of the second acoustic transducer, and the second filter has a second transfer function representing a relation between the second audio signal and the displacement of the first acoustic transducer.

16. The loudspeaker apparatus of claim 15, wherein the controller further comprises:

a first combiner, coupled between the second filter and the first acoustic transducer, and combining the first audio signal and the filtered second audio signal to generate a first compensated audio signal included in the compensated audio signal; and a second combiner, coupled between the first filter and the second acoustic transducer, and combining the second audio signal and the filtered first audio signal to generate a second compensated audio signal included in the compensated audio signal.

* * * * *